United States Patent [19]

Geisinger

[11] 4,432,185

[45] Feb. 21, 1984

[54] PALLET WRAPPER

[76] Inventor: Wolfgang Geisinger, 2125 Hingston Ave., Montreal, Canada, H4A 2H9

[21] Appl. No.: 298,316

[22] Filed: Sep. 1, 1981

[51] Int. Cl.[3] ..... B65B 11/04; B65B 51/05

[52] U.S. Cl. ..... 53/138 R; 53/587; 53/416

[58] Field of Search ..... 53/138 R, 556, 587, 53/588; 100/15, 27, 33 R

[56] References Cited

U.S. PATENT DOCUMENTS

| | | | |
|---|---|---|---|
| 2,124,770 | 7/1938 | Evans | 100/33 R |
| 2,630,751 | 3/1953 | Cranston | 100/27 |
| 3,003,297 | 10/1961 | Broadhead | 100/27 X |
| 3,126,686 | 3/1964 | Kobylanski | 53/138 R |
| 4,077,179 | 3/1978 | Lancaster | 53/556 X |
| 4,110,957 | 9/1978 | Lancaster | 53/588 X |
| 4,216,640 | 8/1980 | Kaufman | 53/587 |
| 4,232,501 | 11/1980 | Stackhouse | 53/587 |
| 4,235,062 | 11/1980 | Lancaster | 53/587 X |
| 4,255,918 | 3/1981 | Lancaster | 53/587 X |
| 4,271,657 | 6/1981 | Lancaster | 53/587 X |
| 4,300,326 | 11/1081 | Stackhouse | 53/587 |

*Primary Examiner*—John Sipos

*Attorney, Agent, or Firm*—Cecil A. Rowley

[57] ABSTRACT

A pellet wrapper adapted to wrap a pallet with a web material comprises, an anvil member movable into position against the side of the pallet, a clamp movable with the anvil and adapted to hold the end of the web with which the pallet is to be wrapped. With the clamp and anvil so positioned adjacent the pallet, the wrapping of the pallet is begun. After the web has wrapped around the pallet at least sufficient turns so that the web overlies the end retained in the clamp and secures this end portion against the side of the pallet, the clamp is then released and retracted and the wrapping of the pallet completed to wrap the pallet and then back to overlapping the layer of web material initially applied to the pallet while forming said web in about the last 1¼ turns into roped form. After the pallet has been wrapped the clamp is again moved into an operative position to clamp a roped section of the web and a suitable securing mechanism is advanced to cooperate with the anvil to secure the web adjacent the clamp to the underlying roped layer of the web and then a cut-off mechanism is advanced to cut the web between the clamp and the point of securement.

6 Claims, 14 Drawing Figures

PALLET WRAPPER

FIELD OF THE INVENTION

The present invention relates to a pallet wrapper. More specifically the present invention relates to an automatic pallet wrapper adapted to apply an untreated wrapping or netting material about a pallet and secure it in position.

BACKGROUND OF THE INVENTION

There are many different forms of pallet wrappers currently available. Most of them operate on the principal of the pallet being positioned on a table or platform, the table rotated to wrap a web of material which is applied to the pallet load, around the pallet load and to cut off and wipe the end of the web against the pallet and thereby securing the wrapper in position i.e. the wrapper web is applied to the pallet and the pallet rotates to wind the web around the pallet and overlap itself. This wraping is continued until the top of the pallet is reached and normally reverses itself back down to the bottom of the pallet. The web is treated with a special finish so that when the web is cut-off after wrapping, the cut-off end adheres to the layers of web previously applied to the pallet.

Pallet wrappers wherein the wrapping material is suspended from above or below and travel around the pallet are also known and operate in a similar manner.

Such wrapper materials are normally not particularly porous and do not permit significant breathing of the pallet load which can lead to condensation or, in many cases, overheating of the pallet load resulting in deterioration of the goods contained in the pallet.

Web material formed of an opened weave, such as a leno-type weave material has long been known and recently a plastic open mesh material has been provided that has adequate strength to properly wrap a pallet, however, these materials have, in the past, always required manual application, thereby limiting severally their use. Even though the open weave material is far superior from a breathing and heat transmission point of view improving the stability of the pallet load under various conditions of temperature and humidity while providing adequate strength to hold the pallet load together, its use has been restricted due to the lack of automatic wrapping equipment. Similarly, untreated plastic wrapping sheet material could not be wrapped automatically.

BRIEF DESCRIPTION OF THE INVENTION

The object of the present invention is to provide an improved automatic pallet wrapper capable of handling untreated sheet material or net-like material.

Broadly the present invention relates to a pallet wrapper comprising; a source of wrapping material, an anvil movable from a remote position to a position in contact with one side of a pellet load, thereby to accurately locate the side of the pallet, clamping means for holding the end of said web wrapping material movable with said anvil to a position adjacent said pallet, securing means for securing said wrapping material to a section of said wrapping material previously wrapped around said pallet and a cut-off mechanism for cutting said web material after said securing means has secured said web. The wrapper further comprises a roping mechanism for converting a portion of the web of wrapping material into a rope form and a positioning member for moving the roped portion into position to be engaged by the clamping means.

The present invention also relates to a method of wrapping a pallet which comprises positioning a pallet, moving an anvil member into engagement with the side of said pallet, simultaneously moving an end of a web held in a clamp positioned adjacent said anvil, wrapping said web about said pallet at least sufficient turns so that the clamped end of said web is overlapped and frictionally retained by a further portion of said web overlapping said anvil and said end held in said clamp, releasing said clamp, withdrawing said clamp to a position clear of said web, completing the wrapping of said pallet while roping a last portion of said web wrapping said pallet to provide a roped section, moving said clamp into operative position and clamping a roped portion of said web, forcing said web adjacent said clamp toward said anvil and securing said web to proviously applied section of said web adjacent said anvil, cutting said web between said clamping means and the location at which said web is fastened to said other previously applied section, retracting said anvil and moving said wrapped pallet.

Further features, objects and advantages will be evident from the following detailed description of the preferred embodiment of the present invention taken in conjunction with the accompanying drawings, in which.

Figure 4:
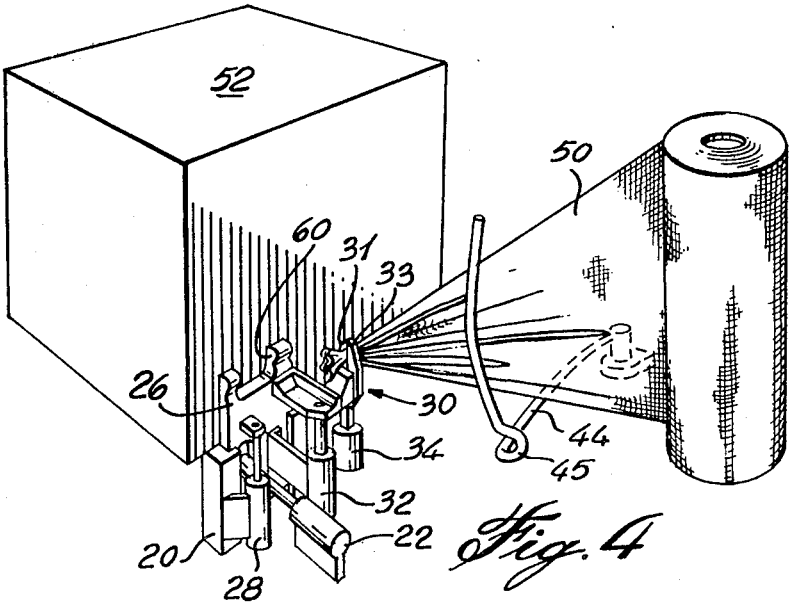

FIG. 4 schematically illustrates the position of the anvil, clamp and web as wrapping of the pallet is begun.

Figure 5:
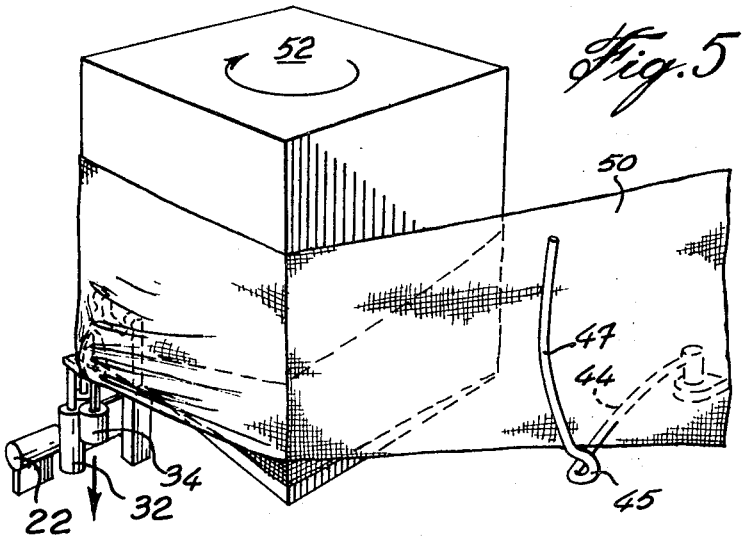

FIG. 5 shows the pallet wrapped for at least sufficient turns to secure the wrapper about the pallet so that the clamp may be released.

Figure 6:
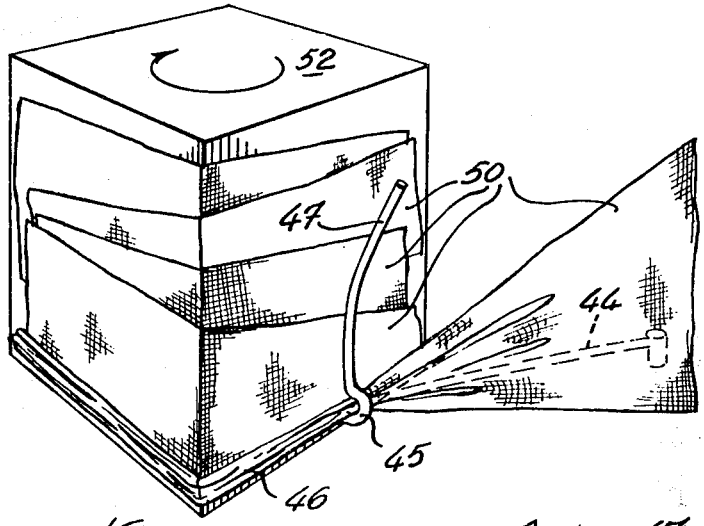

FIG. 6 is a shematic illustration of the roping mechanism about to form a portion of the web into a rope configuration as the wrapping operation is completed.

Figure 1:
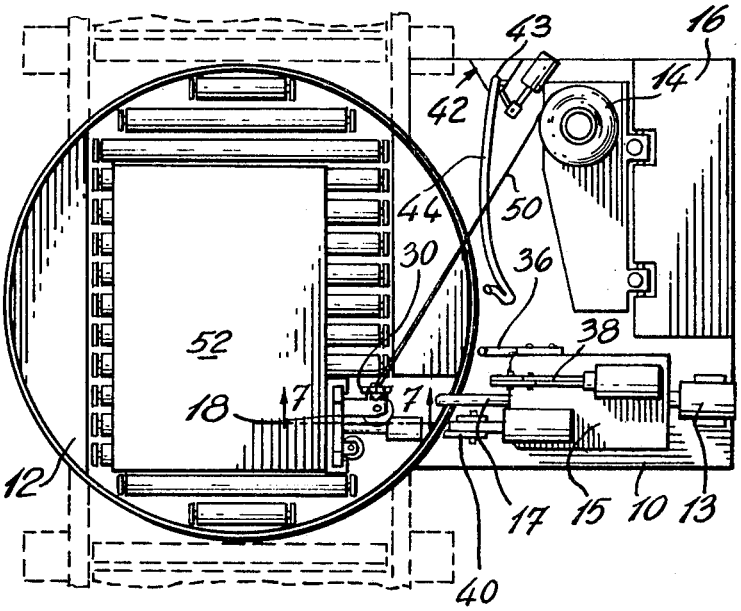
FIG. 1 is a plan view schematically illustrating the pallet wrapper of the present invention.
Figure 7:
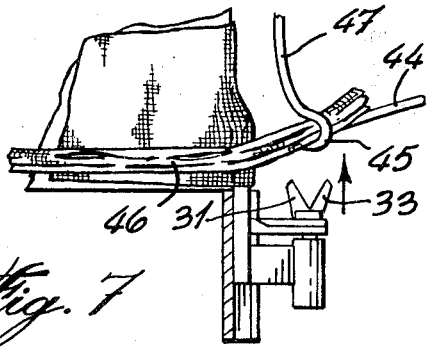

FIG. 7 shows the positioning mechanism moving in engagement with the roped portion of the web and holding it in a position for the clamping mechanism to move into extended position and clamp the rope and is the section taken along the lines 7—7 of FIG. 1.

Figure 8:
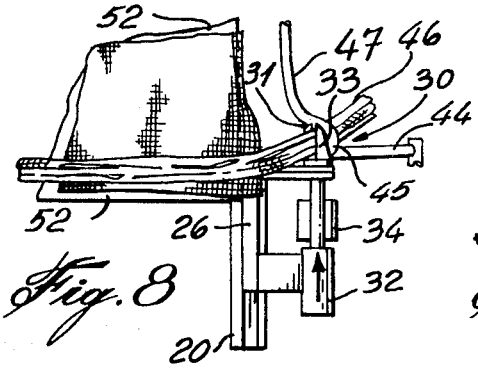

FIG. 8 is a side view of the clamping mechanism holding the roped portion of the web.

Figure 10:
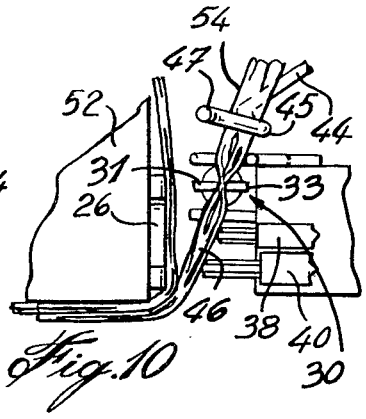
Figure 9:
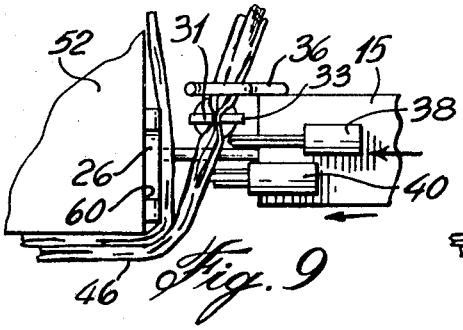
Figure 11:
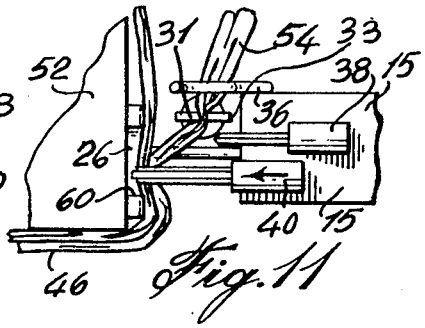

FIGS. 9, 10, 11 and 12 are plan views illustrating the sequence of operation of the various mechanisms. FIG. 9 shows the carriage in advanced position. FIG. 10 is a plan view of what is illustrated in FIG. 8. FIG. 11 illustrates the fastening means in operative position and FIG. 12 the cut-off mechanism in operative position.

Figure 13:
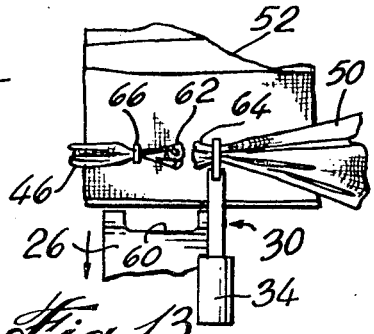

FIG. 13 illustrates the web cut-off and fastened with the free end of the web held in the clamp and with the anvil member retracted to complete the wrapping of the pallet.

Figure 14:
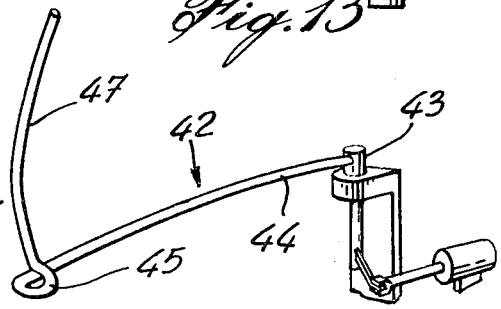

FIG. 14 is an isolated view of one form of roping means.

As shown in FIG. 1, the pallet wrapper of the present invention preferably comprises, a base 10 with a platform 12 mounted thereon and adapted to rotate relative to the base. A roll of wrapping material 14 is mounted on the base 10 on a suitable elevator mechanism 16 which raises and lowers the roll 14 during the wrapping operation in the well known manner.

Figure 3:
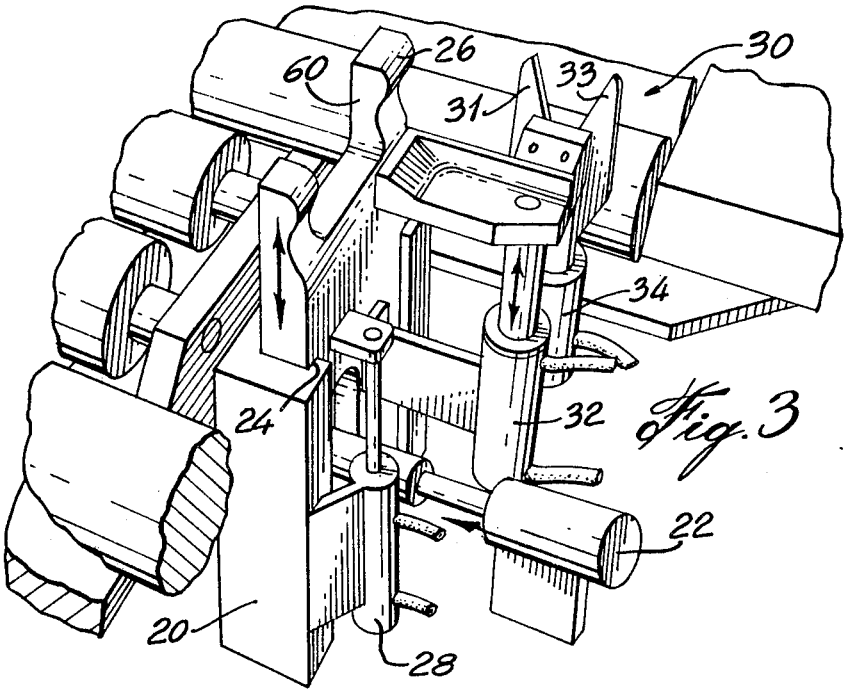
FIG. 3 is a schematic isometric view of the anvil member and clamp, schematically illustrating the mechanism for positioning the anvil and for moving same from an operative to an inoperative position and for positioning the clamp and moving it to an unextended and a retractive position.

Mounted on the platform 12 is an anvil and clamping mechanism generally indicated at 18 (illustrated schematically in more detail in FIG. 3). This mechanism 18 comprises a movable guide member 20 mounted on a suitable track (not shown) on the platform 12. The guide 20 is positioned below the upper surface of the platform 12 and is moved relative to the platform 12 by a suitable mechanism generally indicated by the piston 22 in FIG. 3.

Mounted in suitable vertical tracks 24 in the guide 20 is an anvil member 26 which is adapted to be moved from a retracted position to an extended position via the piston and cylinder arrangement schematically illustrated at 28 so that the anvil 26 is moved vertically relative to the guide member 20.

Also mounted on the guide member 20 is a clamp generally indicated at 30 and movable vertically relative to the guide member via a suitable piston and cylinder arrangement 32. Suitable means 34 may be activated to close the clamp 30, however, the clamp 30 will preferably open simply by a spring action.

As illustrated in FIG. 1, a carriage 15 is movable on base 10 by suitable means such as piston and cylinder 13 toward and away from the platform 12 and is accurately positioned relative to the anvil member 18 by means of a bumper 17 projecting from in front of the carriage. The bumper 17 is a conventional fluid bumper and operates to stop the movement of the carriage 15 towards the platform 12 by stopping flow of fluid to the piston and cylinder 13 when the fluid pressure generated by forcing the bumper 17 against the anvil member 26 reaches a certain pre-set level i.e. it ensures that the carriage 15 is positioned a specified distance from the anvil member 26 and terminates the movement of the carriage 15 when said predetermined pressure is reached.

Mounted on the carriage 15 is a suitable positioning element 36 as well as a cut-off mechanism 38 and a securing mechanism 40 each such mechanism being independently moved toward and away from the anvil 26. These instrumentalities 36, 38 and 40 are simply illustrated schematically as the particular form thereof does not constitute part of the present invention. However, it should be stated that the cut-off mechanism for example, would normally be composed by a pair of shears that are moved into an operative position and then through a cutting motion i.e. the operating shears e.g. a pair of scissors would be extended to cutting position and then rotated on their pivot to cut. Similarly the securing mechanism may simply constitute a stapling device for example a device used for stapling upholstry or in the manufacture of mattresses. This device is moved into a proper postion relative to the anvil and then the staple is set. Both of these devices may be activated pneumatically with the initial movement of the piston of the pneumatic cylinder moving the device into operative position and the final portion of the movement of the piston activating the device to cut or staple.

Also mounted on the base 10 is a roping mechanism 42 which is composed of an arm 44 formed for example from a piece of bent steel rod which is pivotably mounted as indicated at 43 at one side of the web 50 extending from the roll 14 and under the web 50 to the opposite side thereof. The arm 44 is formed with a loop or hook 45 on the side of the web 50 opposite the pivot 43 and terminates in an upstanding section 47 adapted to direct the web into the loop 45 (see FIG. 14) i.e. when the roper 42 is activated by pivoting on pivot 43 to move the loop 45 toward the pallet being wrapped, the section 47 biases the top portion of the web 50 toward the loop 45 and as the roll 14 approaches its lowest position with the roper 42 activated the lower edge of the web 50 engages the arm 44 and is biased into the loop 45 which forms the web 50 into a rope section 46 (see FIGS. 6–13).

Figure 12:
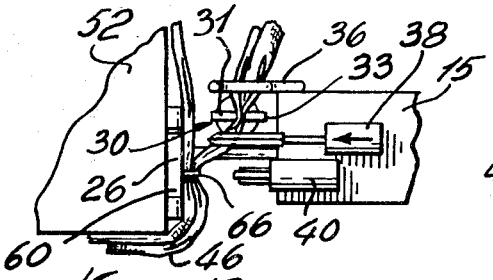

Generally the positioning element 36 may simply comprise an open V-shaped element fixed to the platform 15 in a position to engage a roped portion 46 of the web 50 between the loop 45 and the clamp 30 close to clamp 30 i.e. when the platform 15 is advanced the roped section 46 enters the open V-shaped element 36 that insures the rope 46 is in a position to be engaged by the clamp 30 when it is moved up to clamp the web (see FIGS. 9, 11 and 12).

Having broadly described the structure of the invention, the operation will be described to better illustrate the concept.

First the pallet generally indicated at 52 is positioned on the platform 12, next the anvil member 26 is raised to an elevated position above the surface of the platform 12 and the guide member 20 is moved toward the pallet 52 until the anvil 26 contacts with the pallet 52. At this point the pressure in the cylinder piston arrangement generally indicated at 22 begins to increase and when it reaches a pre-set level it automatically cuts-off (in a well known manner) thereby maintaining the anvil 26 in raised position against the side of the pallet. At this point in time, the clamp member 30 is in elevated postiion and has the free roped end of the web 50 clamped therein as indicated in FIG. 4. The roping mechanism 42 is in inoperative position.

With the mechanism as illustrated in FIG. 4, the pallet 52 is rotated by rotating the platform 12 which wraps the web 50 around the periphery of the pallet 52 until the web 50 overlaps itself and the anvil 26 as well as the clamp 30 and the portion of the web 50 extending from the clamp 30 as shown in FIG. 5. After the web 50 has been wrapped around the pallet sufficiently to frictionally hold the end retained in the clamp in postion against the pallet, the clamp 30 is released and retracted downwards. This generally requires about 1¼ turns of the web 50 about the pallet. Obviously, the clamp 30 will not open completely until it is clear of the overlying portion of the web 50 as there is no room for it to open since the web 50 is pulled tightly thereover. However, it will release enough to slide down and leave the end portion trapped under the next overlying layer of the web 50.

At this point the anvil will be wrapped by the web 50 i.e. it will be between the pallet 52 and the wrapper 50.

The wrapping of the pallet 52 is continued until the wrapper has proceeded to the top of the pallet and back down toward the bottom of the pallet when the web 50 is wrapping near to the bottom of the pallet the roping mechanism 42 will be activated so that the arm 44 moves clockwise, the upstanding section 47 engages the web 50 as does the top of the arm 44 to fold the web 50 into a roped shape 46 and wedge it into the loop 45. Generally the last about 1¼ turns around the bottom of the pallet will be roped as indicated in FIG. 6.

After the web has completely wrapped the pallet, the platform 12 is moved into position so that the web 50 passing from the pallet to the roll 14 extends adjacent the anvil 26. At this point the roper 42 is in active position and the carriage 15 is moved to advanced position a pre-set distance from anvil 26 as determined by the bumper 17 (see FIG. 9) and the positioning element 36 engages the rope section 46 (as shown in FIG. 7) and helps to ensure that the roped section 46 is in a position directly overlying the clamp 30. The clamp 30 in open position is then elevated so that the rope portion 46 is received between the two arms 31 and 33 (see FIG. 3) of the clamp and the clamp is then closed via the mechanism 34 to securely hold the roped portion 46 of the web 50 as shown in FIGS. 8 to 13 and 1 and 2.

With the roped section 46 retained in the clamp 30 and positioned in overlying relationship to the anvil 26, the securing mechanism 40 is moved to advanced position as shown in FIG. 11 to secure the roped section 46 to previously wrapped layer or layers of the web 50, normally to a previously wrapped roped layer. It will be noted that the anvil member 26 is cut away in the center as generally indicated at 60 as best shown in FIG. 3 to provide clearance for the securing mechanism 40 i.e. if a stapler is used as is intended with the present invention, the anvil presents the ends of the staple from penetrating the pallet and yet provides a solid member against which the webing or other wrapping material may be forced during stapling. The thickness of the anvil 26 and the cut away portion 60 provide clearance for the staples to extend through the web 50 and secure the roped portion 46 thereto.

After the stapling or securing operation, the shear 38 is advanced and cuts the web between the securing staple 66 and the clamp 30 the clamp is spaced sufficiently far from the anvil 26 so that the shear 38 may cut-off the roped section 46 without damaging the underlying layers of the web 50 and provide a pair of cut ends 62 and 64 (see FIGS. 12 & 13).

Figure 2:
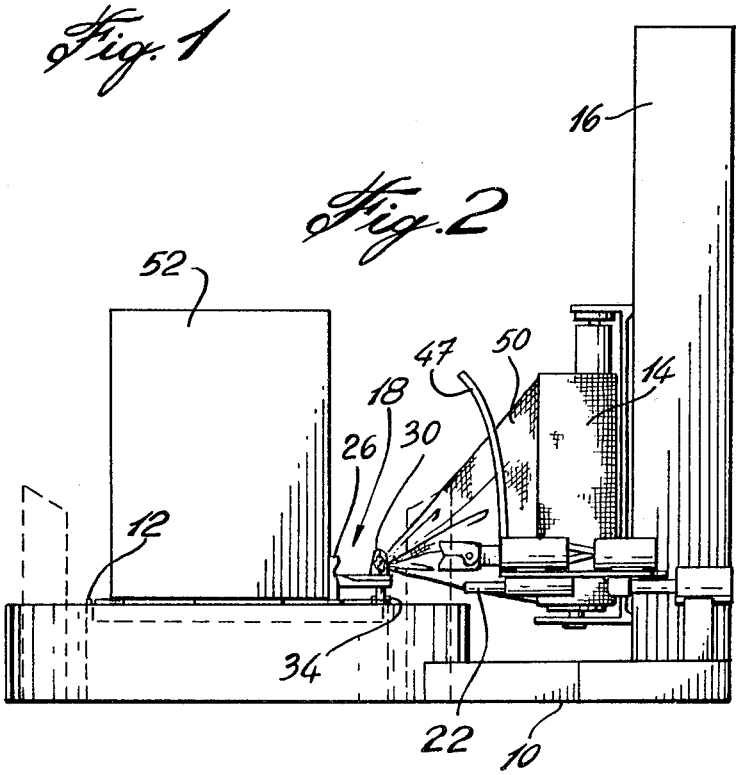
FIG. 2 is a side elevation schematically illustrating the present invention.

The anvil member 26 is now retracted by drawing same downwardly as indicated in FIG. 13 and then the guide 20 moved to its initial position i.e. retracted out toward the periphery of the platform 12 in a position to permit the next pallet 52 to be placed on the platform 12 and the roped end 46 is held within the clamp 30 as shown in FIGS. 1 and 2 and is ready to be moved into operative position when the anvil 26 is moved into position contacting the next pallet 52 positioned on the platform 12.

The sequence of operation of the various operating elements may be controlled in the well known manner by a suitable control mechanism activated by appropriately located sensors or activators.

Having described the invention, modifications will be evident to those skilled in the art without departing from the spirit of the invention as defined in the appended claims.

I claim:

1. A pallet wrapper comprising; a web of wrapping material feedable from a suitable supply, a guide means, an anvil means mounted on said guide means; means to position said anvil means including means to move said anvil means between a retracted position and an extended operative position relative the guide means and the pallet and means to move said guide means between an extended position wherein said anvil means in said operative position is in engagement with the side of a pallet when a pallet is in position and a retracted position spaced from said pallet, a clamp for clamping said web material mounted on said guide means, means for moving said clamp relative to said guide means between an extended position spaced from said pallet and adjacent said anvil, when said anvil is in operative position and a retracted position, means for closing said clamp when in said extended position to hold said web, means for relatively moving said web and said pallet thereby to wrap said web around said pallet in a wrapping operation, during said wrapping operation said web extends around said pallet and in overlying relationship with said anvil and said clamp and the end of said web retained in said clamp thereby to hold the web against the pallet, means for opening said clamp to release the web, said clamp moving means moving said clamp from between said web and said pallet into said inoperative retracted position clear of said web while said web is so held against the pallet, a securing mechanism, means for moving said securing mechanism into position to secure a last layer of said wrapping material when said pallet wrapping operation is substantially completed to an underlying layer thereof adjacent said anvil and a cut-off mechanism for cutting-off said web between said securing means and said clamping means and means to move said cut-off means into cutting position and to activate said cut-off mechanism.

2. A pallet wrapper as defined in claim 1 wherein said securing means and said cut-off mechanism are movably mounted on a carriage and means are provided to move said carriage into a pre-set position relative to said anvil means when said anvil means is in position against said pallet.

3. A pellet wrapper as defined in claims 1 or 2 further comprising, a roping mechanism, means for moving said roping mechanism from an inoperative to an operative position against said web between said pallet and said supply, to form said web into a rope adapted to be engaged by said clamp as said web is fed from said supply and wrapped about said pallet during the latter part of the wrapping operation.

4. A pallet wrapper as defined in claim 1 further comprising, a roping mechanism, means for moving said roping mechanism from an inoperative to an operative position against said web between said pallet and said supply, to form said web into a rope adapted to be engaged by said clamp as said web is from said supply and wrapped about said pallet during the latter part of the wrapping operation.

5. A pallet wrapper as defined in claims 1 or 2 wherein said securing mechanism comprises a stapler.

6. A pallet wrapper as defined in claim 4 wherein said securing mechanism comprises a stapler.

* * * * *